US009863744B2

(12) United States Patent
Allison

(10) Patent No.: US 9,863,744 B2
(45) Date of Patent: Jan. 9, 2018

(54) ONE-PIECE FOUR-BLADE MACHINED BROADHEAD AND SHARPENER

(71) Applicant: Thomas G. Allison, Lakeville, MN (US)

(72) Inventor: Thomas G. Allison, Lakeville, MN (US)

( * ) Notice: Subject to any disclaimer, the term of this patent is extended or adjusted under 35 U.S.C. 154(b) by 278 days.

(21) Appl. No.: 14/751,974

(22) Filed: Jun. 26, 2015

(65) Prior Publication Data

US 2016/0377395 A1 Dec. 29, 2016

(51) Int. Cl.

| | |
|---|---|
| ***F42B 6/08*** | (2006.01) |
| ***B24D 15/06*** | (2006.01) |
| ***F42B 33/00*** | (2006.01) |

(52) U.S. Cl.

CPC ..... *F42B 6/08* (2013.01); *B24D 15/06* (2013.01); *F42B 33/001* (2013.01)

(58) Field of Classification Search

CPC ..... F42B 6/08; F42B 33/001; B24D 15/06
See application file for complete search history.

(56) References Cited

U.S. PATENT DOCUMENTS 2,905,470 A * 9/1959 Hoyt, Jr. ..... F42B 6/08 473/582
3,915,455 A * 10/1975 Savora ..... F42B 6/08 473/584
4,234,191 A * 11/1980 Erlandson ..... F42B 6/08 473/583
7,905,795 B1 * 3/2011 Nuno ..... F42B 6/08 473/253
2004/0176229 A1 * 9/2004 Soroka ..... B23K 26/1482 483/14
2010/0069182 A1 * 3/2010 Baker ..... F42B 6/08 473/583

OTHER PUBLICATIONS

Internet Web Archive <https://web.archive.org/web/20130806050016/http://www.gentmachine.com:80/industries/cnc-parts/>.*
Precision Manufacture of titanium alloy broadhead with sliding headstock <http://www.telfid.com/jmjg/videoes.html>.*
WASP "Broadheads Made in the USA, built by America" <https://www.youtube.com/watch?v=_jVcwMIzJJQ>.*
Affidavit of Thomas G. Allison dated Jun. 10, 2016 (2 pages).

* cited by examiner

*Primary Examiner* — Jacob Cigna
(74) *Attorney, Agent, or Firm* — Winthrop & Weinstine, P.A.

(57) ABSTRACT

A one-piece four-blade machined broadhead and sharpener for sharpening the blades of a four-blade broadhead is described. A broadhead may be machined as a single component from, for example, bar stock material. A broadhead of the present disclosure may be machined on a multi-spindle machine such as but not limited to a Swiss or Swiss-style screw machine. A broadhead may be machined in a reverse configuration such that an attachment end for attaching the broadhead to an arrow is positioned at or near an open end of the bar stock material. One or more steps of the broadhead machining or manufacturing process may be automated, for example by the use of one or more robotic gripping arms. Furthermore, a sharpener of the present disclosure may have sharpening stones positioned at angles such that a two blades of a four-blade broadhead may be simultaneously sharpened.

16 Claims, 8 Drawing Sheets

ONE-PIECE FOUR-BLADE MACHINED BROADHEAD AND SHARPENER

FIELD OF THE INVENTION

The present disclosure relates to machined arrow broadheads. Particularly, the present disclosure relates to machined broadheads having four blades. More particularly, the present disclosure relates to machined broadheads having four blades that are machined as one piece and to sharpeners for sharpening such broadhead blades.

BACKGROUND OF THE INVENTION

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Different types of arrowheads may be used for archery, bow hunting, or other bow and arrow or crossbow activities. One category of arrowhead commonly used is a broadhead. A broadhead may have any number of blades. The blades of a broadhead may be fixed or moveable. For example, one or more blades may be designed to expand on or after contact with a target. Additionally or alternatively, one or more blades may be designed to be removable. In some cases, blades may be designed to be replaceable, for example after wear and tear or dulling of the blades. Such movable or replaceable blades may be prone to being misplaced, breaking, or otherwise malfunctioning. If any one blade on a multi-blade broadhead is missing or otherwise not operating correctly, the broadhead typically will not function correctly as a result. For example, the arrow's or bolt's trajectory, speed, or other parameter or characteristic related to functionality may be affected.

Broadheads may be machined as multiple parts that are assembled through welding or other coupling mechanisms. The various individual pieces may cause problems during use of the broadhead, particularly where there are moveable components. Multiple machined pieces may be prone to breakage, and may be particularly vulnerable to breaking along weld lines or other joints or hinges. Broadheads machined with multiple parts may also be prone to having individual pieces misplaced, broken, or otherwise malfunction, and if any one of the multiple pieces is lost, malfunctions, or breaks, the entire broadhead is typically rendered inoperable as a result. Furthermore, joints or connection points, such as weld lines or hinges, may affect the aerodynamic properties of the broadhead, and may affect the speed, trajectory, or other parameters or characteristics related to functionality of an arrow or bolt.

Thus, there is a need in the art for an improved four-blade broadhead. More particularly, there is a need for an improved four-blade broadhead machined as a single component.

BRIEF SUMMARY OF THE INVENTION

The following presents a simplified summary of one or more embodiments of the present disclosure in order to provide a basic understanding of such embodiments. This summary is not an extensive overview of all contemplated embodiments, and is intended to neither identify key or critical elements of all embodiments, nor delineate the scope of any or all embodiments.

The present disclosure, in one embodiment, relates to a method of making a single-piece four-blade broadhead from a bar stock material, such as but not limited to a steel bar stock, the broadhead having an attachment end for attaching to an arrow and a pointed end opposite the attachment end, and the bar stock material having an open end. The method may include machining the single-piece broadhead from the bar stock material such that an attachment end of the broadhead is nearer the open end of the bar stock than an end of the broadhead resulting in the pointed end. The machining may be performed on a Swiss screw machine. In some embodiments, the Swiss screw machine includes a first spindle and a second spindle, and a first portion of the broadhead is machined on the first spindle and a second portion of the broadhead is machined on the second spindle. In certain embodiments, the first portion may include all rough machining excluding at least a final point at the end of the broadhead resulting in the pointed end. Furthermore, the second portion may include at least the final point of the broadhead. Still further embodiments may include cutting the broadhead from the bar stock material after the first portion of the broadhead is machined, and before the second portion of the broadhead is machined. In some embodiments, the method may include grinding each of the broadhead's four blades to an included angle of about 45 degrees. A first robotic gripping arm and a second robotic gripping arm may facilitate the grinding step. More specifically, a first robotic gripping arm may remove a first broadhead from an array of broadheads and load the first broadhead into a grinder, and a second robotic gripping arm may unload the first broadhead from the grinder after grinding is complete. In some embodiments, the method may include heat-treating the broadhead and/or applying a black-oxide coating to the broadhead.

The present disclosure, in another embodiment, relates to a method of making a plurality of single-piece four-blade broadheads from a bar stock material. The method may include machining each of the broadheads, wherein each broadhead comprises a single piece; placing the plurality of broadheads in an array; and for each of the plurality of broadheads: using a first robotic gripping arm, removing the broadhead from the array and positioning it in a grinding machine; grinding the four blades of the broadhead to an included angle; and using a second robotic gripping arm, removing the broadhead from the grinding machine. In some embodiments, the included angle is about 45 degrees. In still further embodiments, the machining is performed on a Swiss screw machine. More specifically, the Swiss screw machine used may include a first spindle and a second spindle, wherein a first portion of the broadhead is machined on the first spindle and a second portion of the broadhead is machined on the second spindle. As indicated above, in some embodiments, the first portion may include all rough machining excluding at least a final point at an end of the broadhead.

The present disclosure, in yet another embodiment, relates to a sharpener for sharpening a four-blade broadhead, the four blades each having a sharpened end ground to an included grind angle. The sharpener may include first and second surfaces for accommodating a sharpening surface and a gap sized to receive a blade of the four-blade broadhead positioned between the first and second surfaces. The first and second surfaces may be positioned at a non-parallel angle from each other. In some embodiments, the sharpener may include first and second sharpening surfaces, which may be removable sharpening surfaces, such as conventional sharpening stones.

While multiple embodiments are disclosed, still other embodiments of the present disclosure will become apparent to those skilled in the art from the following detailed description, which shows and describes illustrative embodiments of the invention. As will be realized, the various embodiments of the present disclosure are capable of modifications in various obvious aspects, all without departing from the spirit and scope of the present disclosure. Accordingly, the drawings and detailed description are to be regarded as illustrative in nature and not restrictive.

BRIEF DESCRIPTION OF THE DRAWINGS

While the specification concludes with claims particularly pointing out and distinctly claiming the subject matter that is regarded as forming the various embodiments of the present disclosure, it is believed that the invention will be better understood from the following description taken in conjunction with the accompanying Figures, in which:

DETAILED DESCRIPTION

The present disclosure relates to novel and advantageous arrow broadheads. Particularly, the present disclosure relates to novel and advantageous broadheads having four blades and machined as a single piece, and methods of making the same. The present disclosure further relates to novel and advantageous sharpeners for sharpening a one-piece four-blade broadhead of the present disclosure.

In general, a broadhead of the present disclosure may have four fixed blades extending from a central shaft that comes to a point. A broadhead of the present disclosure may be machined as a single piece from, for example, a single bar stock. The machining operation may involve one or more operations or steps, and may be fully or partially automated as will be explained in further detail below. A broadhead of the present disclosure may exhibit improved speed and/or trajectory.

In general, a sharpener of the present disclosure may operate in conjunction with a one-piece four-blade broadhead of the present disclosure. Specifically, a sharpener of the present disclosure may be designed with or to accommodate sharpening stones aligned at particular angles that coordinate with particular angles of a broadhead of the present disclosure, such that the sharpener can simultaneously sharpen more than one blade of the broadhead.

Broadhead

Figure 1:
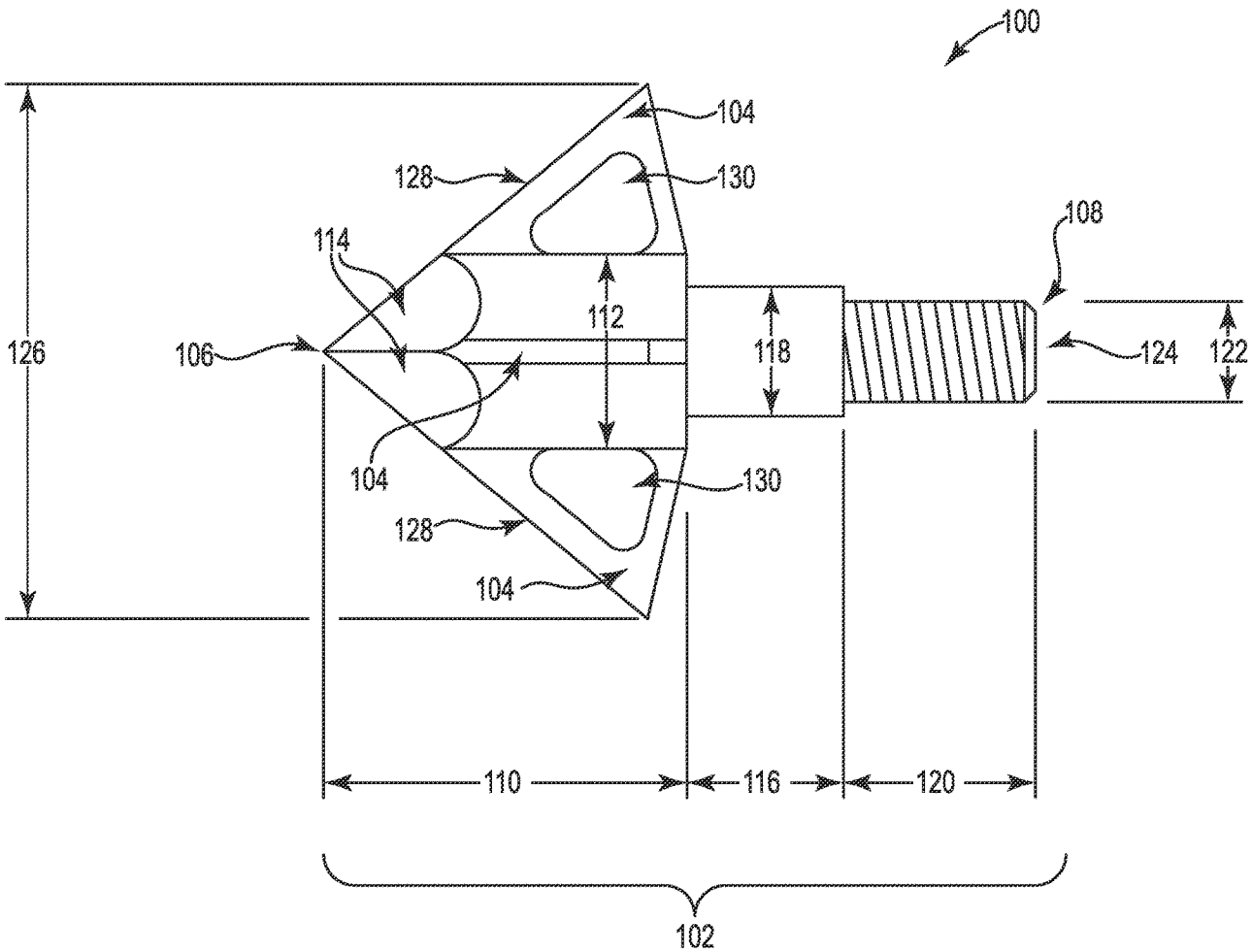
FIG. 1 is a schematic of a one-piece four-blade machined broadhead according to one embodiment of the present disclosure.
Figure 2:
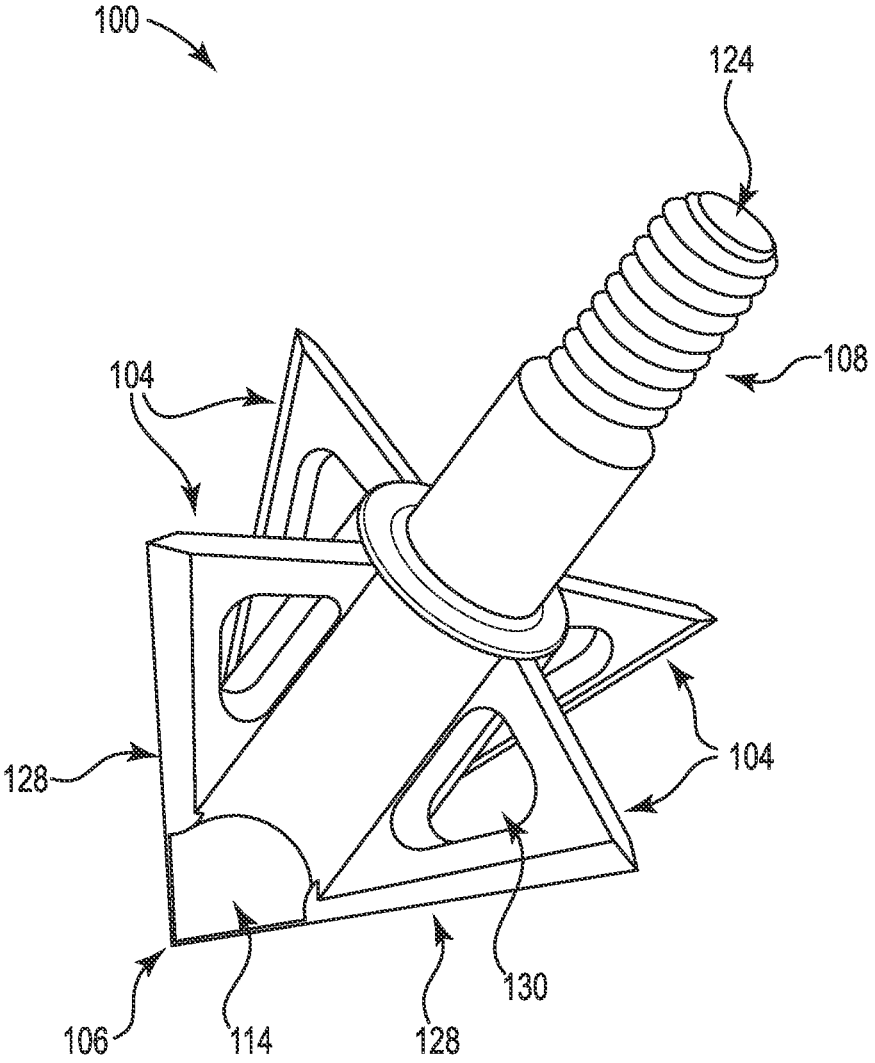
FIG. 2 is a perspective view of the one-piece four-blade machined broadhead of FIG. 1.

FIGS. 1 and 2 illustrate one embodiment 100 of a one-piece four-blade broadhead of the present disclosure. The broadhead 100 may have a central shaft 102 supporting four blades 104 that extend outward from the shaft. A point 106 may be formed at one end of the shaft 102. The broadhead 100 may have an attachment mechanism 108 at one end of the shaft, opposite the point 106, by which the broadhead may be coupled to an arrow shaft or crossbow bolt shaft.

Figure 3:
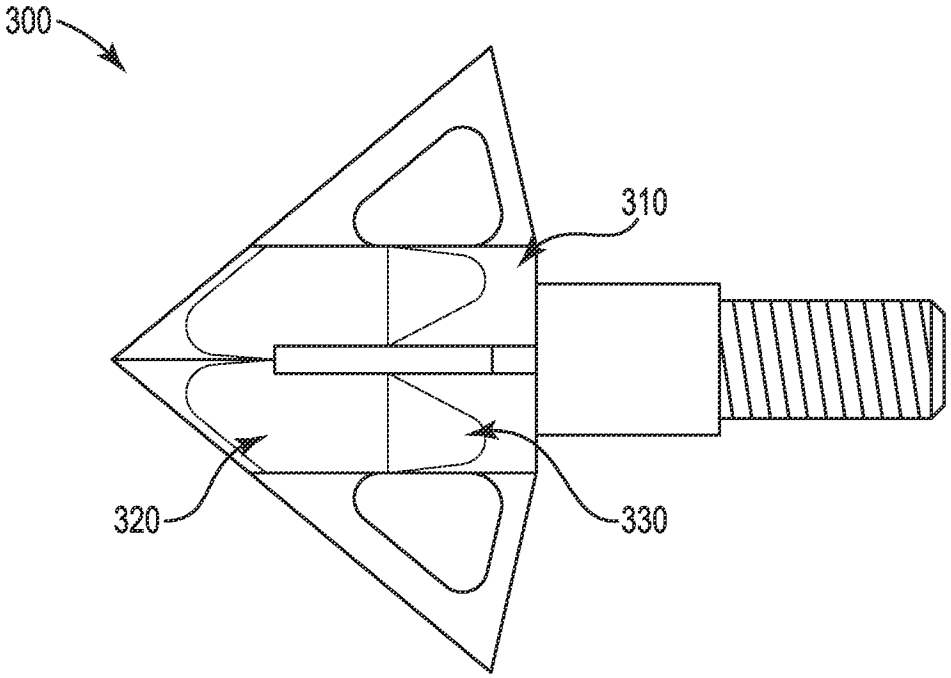
FIG. 3 is a schematic of a one-piece four-blade machined broadhead according to another embodiment of the present disclosure.

The central shaft 102 of the broadhead 100 may generally have a round or other suitable cross sectional shape. The shaft 102 may have any suitable length. In some embodiments, the length of the shaft 102 may be between one and two inches. In other embodiments, the length of the shaft 102 may be any suitable length which may be shorter than one inch or longer than two inches. The shaft 102 may be segmented into multiple sections, each having a different width or diameter and/or cross sectional shape. For example, as show in FIG. 1, the shaft 102 may have a first section or length 110 having a first maximum width or diameter 112. The first section 110 may have any suitable length. Likewise, the first width or diameter 112 may be any suitable width or diameter, and in some embodiments may be between 0.25 and 0.5 inches. The first section 110 may extend from the point 106 down to a location on the shaft 102 from which the four blades 104 extend radially or outward. The first section 110 of the shaft 102 may taper or narrow at an end of the broadhead 100, leading to the point 106. The point 106 may be sharp, dull, or any level of sharpness therebetween. The first section 110 may have one or more contours 114 machined therein. In some embodiments, for example as shown in FIGS. 1 and 2, there may be a contour 114 in the first section 110 between each pair of blades 104, such that there are four contours. Each contour 114 may extend from the point 106 down to any length along the first section 110. In other embodiments, the first section 110 may have one or more contours at any other location or locations along its length. Each contour 114 may be concave, such as the contours shown in FIGS. 1 and 2, or convex. One or more contours 114 may be at different angles or depths into the first length 110 of the shaft 102. For example, FIG. 3 illustrates a broadhead 300 of the present disclosure wherein the first section 310 comprises two concave contours 320, 330 between each pair of blades. Contours 320, 330 may have different depths and/or angles. In other embodiments, the broadhead 100 may have one or more contours 114 at any location along the shaft 102.

The shaft 102 may have a second section 116 extending from the first section 110. The second section 116 may have second maximum width or diameter 118, which may be equal to, larger than, or smaller than the first diameter 112 of the first section 110. The second section 116 may also have any suitable length, and may be equal to, longer, or shorter than the first section 110. The transition between the first length 110 and second length 116 may be an immediate change, as shown in FIG. 1 for example, or may be a gradual taper or stepped transition in other embodiments. In some embodiments, second section 116 may be relatively smooth, while in other embodiments may be textured or countered as desired.

The shaft 102 may have a third section 120 having a third width or diameter 122. The third section 120 may be equal to, longer, or shorter than either of the first and second sections 110, 116. Likewise, the third width or diameter 122 may be equal to, less than, or greater than either of the first or second widths/diameters 112, 118. The third section 120 may extend from the second section 116 to an end 124 of the shaft 102, which may be an opposite end from the point 106. The transition between the second section 116 and third section 120 may be an immediate change, as shown in FIG. 1 for example, or may be a gradual taper or stepped transition in other embodiments. While illustrated with three section 110, 116, 120, a broadhead of the present disclosure may have any number of segments and diameters along its central shaft, including more or less than three.

The broadhead 100 may have an attachment mechanism 108 by which the broadhead is coupled to an arrow, for example. The attachment mechanism 108 may be located generally at or near an end 124 of the shaft 102 opposite the point 106. The attachment mechanism 108 may be any means of attachment, such as but not limited to, threading, a hinged mechanism, a spring and ball plunger mechanism, or any other suitable attachment means. In some embodiments, as shown for example in FIG. 1, the attachment mechanism 108 may constitute or comprise at least a portion of, and up to the entirety of, the third section 120 of the shaft 102. For example, where the attachment mechanism 108 is threading, the threading may extend from the end 124 toward section 116 to a length equal to or less than that of the length of the third section 120. In other embodiments, the attachment mechanism 108 may be located at any suitable point along the shaft 102, such that the broadhead 100 may be suitably coupled to an arrow, for example. The attachment mechanism 108 may be sized for standard sizes or types of arrows or crossbow bolts. The attachment mechanism 108 may additionally or alternatively be sized for a custom sized or type of arrow or crossbow bolt.

A broadhead of the present disclosure may be a four-blade broadhead 100, such as that shown in FIGS. 1 and 2 for example. Each of the four blades 104 may generally extend radially or outward from the shaft 102. Each blade 104 may have a generally triangular shape as viewed from the side of the blade, wherein two points of the triangle are along the shaft 102, and a third point lies radially outward from the shaft. The triangular shape may have any suitable angles and edge lengths. In other embodiments, the blades 104 may extend from the shaft 102 in any suitable shape, such as in an arced, rectangular, or other polygonal shape for example. In some embodiments, one or more blades 104 may generally spiral or twist circumferentially around the shaft 102 as it extends radially, while in other embodiments, the blades 104 may simply extend radially from the shaft 102 at a generally perpendicular direction from the longitudinal axis of the shaft, as illustrated in FIGS. 1 and 2. In still other embodiments, the blades 104 may radially extend from the shaft 102 at any suitable angle or angles. In some embodiments, the blades 104 may each extend from the first section 110 of the shaft 102. In other embodiments, the blades 104 may extend from any suitable location along the shaft 102. Each blade 104 may extend a distance of between about 0.1 to 1.0 inches, or any other suitable distance out from the shaft 102. The four blades 104 may be arranged equidistant from one another circumferentially around the shaft 102. In this way, a first blade may be arranged perpendicular or substantially perpendicular to each of a second and third blades, on either side of the first blade, and in alignment or substantial alignment with a fourth blade on the opposite side of the shaft 102 from the first blade. The distance between the outermost points of two blades 104 on opposite sides of the shaft 102, and thus a maximum width or diameter of the broadhead 126, may be between about 0.5 and 3.0 inches in some embodiments. In certain embodiments, the maximum diameter of the broadhead may be about 1.0 inch or about 1.25 inches. Of course, the overall maximum diameter of the broadhead 126 may be any suitable diameter in other embodiments. Each blade 104 may have a thickness of between about 0.01 and 0.05 inches in some embodiments. However, the thickness of the blades 104 may be any suitable thickness in other embodiments. One or more blades 104 may have a sharpened edge 128 on one or more sides of the blade. In one embodiment, the edges may be sharpened to a 45 degree included angle. One or more blades 104 may have one or more contours or through holes 130. As shown in FIG. 1, a contour or through hole 130 may generally be triangular in shape with curved or straight sides and angles. In other embodiments, the contours or through holes 130 may be any suitable shape. The shape of the contours or through holes 130 may be similar to that of the blades 140 themselves, or may have a different shape than the blades in other embodiments.

A broadhead of the present disclosure may be made of steel, carbon steel, aluminum, plastic, or any other suitable material. More specifically, a broadhead of the present disclosure may be made using a bar stock material, such as steel bar stock, or any other suitable bar stock material. One example of a type of steel that may be used is a low, medium, or high carbon steel such as, but not limited to, Society of Automotive Engineers or American Iron and Steel Institute classification number 11L41. Other steel classification numbers or types or grades of steel may be used in various embodiments. Where bar stock material is used, the bar stock may have any suitable diameter or width. In some embodiments, the maximum diameter of the finished broadhead may equate or nearly equate to the diameter of the bar stock used in the machining process. For example, where bar stock with one-inch diameter is used to machine a broadhead 100 of the present disclosure, the resulting broadhead may similarly have a maximum diameter 126 of one inch. Of course, in other embodiments, the final width or diameter of the broadhead may differ than that of the bar stock used. A machined broadhead of the present disclosure may have a standard broadhead weight such as but not limited to 75 grain, 85 grain, 90 grain, 100 grain, or 125 grain, for example. In other embodiments, a machined broadhead of the present disclosure may have any suitable weight. A broadhead of the present disclosure may be machined as a single component. That is, a broadhead of the present disclosure may be formed as one piece without the need for welding or other coupling devices. In this way, a single-piece machined broadhead of the present disclosure may have improved aerodynamics, and may be less prone to breakage or other malfunctioning.

Machining

A broadhead of the present disclosure may be machined or partially machined using one or more automatic lathes such as, for example, a screw machine, or other machine having multiple axes and/or spindles. A Swiss screw machine or Swiss-style screw machine may be used in some embodiments. One type of Swiss screw machine used to machine a broadhead of the present disclosure may have ten axes and two spindles. In other embodiments, a Swiss screw machine or other machine used may have any number of axes and/or spindles. Additionally or alternatively, other machining equipment, tools, or operations may be used in some embodiments. A screw machine, such as a Swiss screw machine or Swiss-style screw machine, or any other machine or apparatus used during the machining or manufacture of a broadhead of the present disclosure may be operated by or configured to receive computer-executable machining instructions. Such instructions may be input directly into the machine or may be received over a network.

Figure 8:
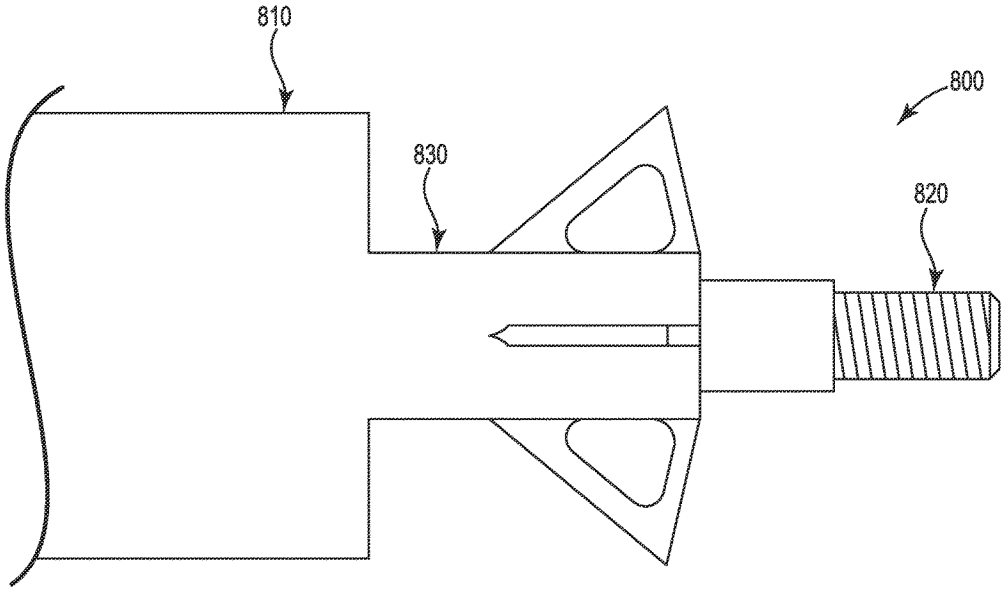
FIG. 8 is a schematic of a one-piece four-blade partially machined broadhead according to one embodiment of the present disclosure.

In one embodiment, a broadhead 100 of the present disclosure may be machined, in an initial machining process, such that an attachment mechanism 108 of the broadhead is machined at the free end or open end of a bar stock, and a point 106 is machined at a connected or closed end of the bar stock. More specifically, whereas broadheads may more typically be machined to substantial completion with the point of the broadhead at the open end of a bar stock, a broadhead of the present disclosure may instead be partially machined in an initial machining process in a generally reverse configuration, with the attachment mechanism end 820 of the broadhead machined starting from or near the open end of the bar stock 810, as shown for example in FIG. 8. As illustrated in FIG. 8, the partially-machined broadhead 800 remains, at least for a portion of time, attached to the bar stock 810 at the end of the broadhead 830 that will ultimately be machined to a pointed end. The attachment mechanism 820 end of the broadhead 800 is configured or positioned at the open end of the bar stock. As will be more fully described below, the partially-machined broadhead 800 may be cut from the bar stock 810 generally at or near the interface of the bar stock 810 and end 830 of the broadhead in order to complete machining of the pointed end in a subsequent machining process. Such "reverse" configuration machining and two-step machining may allow for faster production times and/or more efficient machining.

More specifically, to perform such "reverse" configuration machining, in one embodiment, a first spindle on a machine such as a Swiss screw machine may be used for a portion of the machining, and in some cases a majority of the machining or rough machining. A second spindle may subsequently be used to perform another portion of the machining, such as for example to generally complete the rough machining of the broadhead after the work on the first spindle is complete. As used herein, rough machining is used to generally to refer to the machining completed prior to the machining of blade edges 128. Of course, in other embodiments, a different level of machining, either more or less complete than the rough machining referred to herein, may also define where the majority of machining is substantially complete or otherwise define a division of machining steps. As an example, all rough machining of the broadhead 100, with the exception of the point 106 and contours 114, may be performed on the first spindle. The broadhead 100 may then be cut from the bar stock, if not already cut therefrom, and the second spindle may be used to complete or perform the rough machining of the broadhead point 106 and/or contours 114, according to some embodiments. By beginning machining on the first spindle in a reverse configuration, as described above, the broadhead can then be removed from the first spindle, and securely mounted to the second spindle for machining of the point 106 and contours 114, using the completed or nearly completed attachment mechanism side of the broadhead for support while the point and contours are machined.

Traditionally, all machining or rough machining of single-piece broadheads was performed on a single spindle. With the traditional configuration of the point of the broadhead positioned at the open end of the bar stock, machining was performed on a single spindle because such traditional configuration or positioning of the broadhead did not allow for sufficient support between the broadhead and the bar stock to move the partially completed broadhead to a second spindle. In contrast, the reverse direction machining described above allows for a stronger connection between the partially completed broadhead and the bar stock. As shown for example in FIG. 8, before the point is machined, the partially machined broadhead 800 may include an elongated shaft section 830 connected to the bar stock 810 that is wider or larger than the attachment mechanism end 820. In this way, such reverse configuration machining allows for a stronger connection of the partially machined broadhead 800 to the bar stock 810 for the initial machining step. With the stronger connection between the partially machined broadhead 800 and bar stock 810, the broadhead can be more effectively and efficiently machined, and more easily transported to the second spindle, thus allowing for efficient use of both first and second spindles. Moreover, while rough machining of a first broadhead is being completed on the second spindle, machining of a second broadhead may begin on the first spindle. In this way, both first and second spindles may be efficiently used to machine more than one broadhead at a time. In some embodiments, such reverse configuration machining with the use of two spindles may reduce the average machining time of a broadhead from about seven minutes, with a traditional configuration and single spindle, to about five minutes. In other embodiments, a broadhead of the present disclosure may be machined or manufactured in any suitable configuration or manner, and may be performed on any suitable number of spindles.

Figure 4:
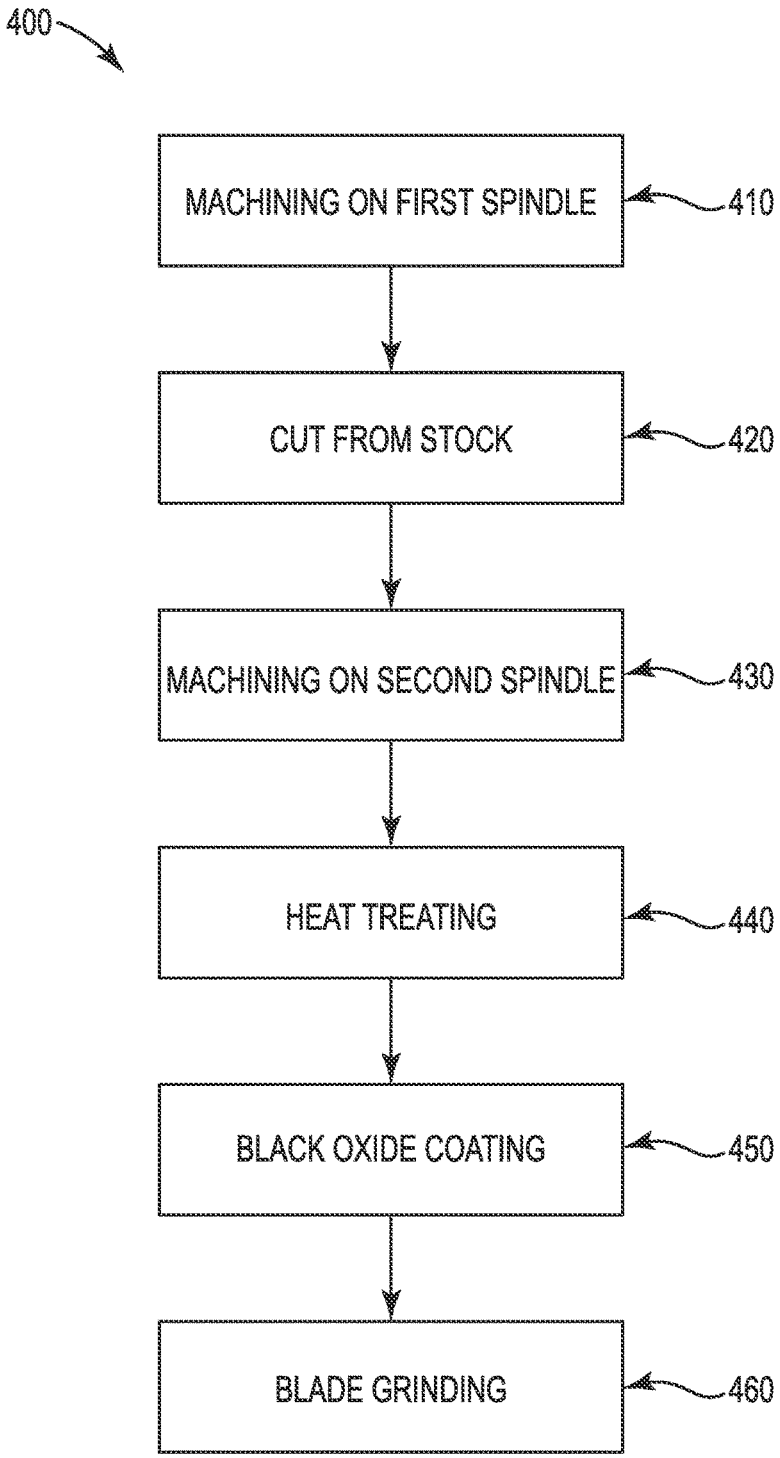
FIG. 4 is a flowchart of an example process for machining a broadhead according to one embodiment of the present disclosure.

FIG. 4 shows one example of a series of steps 400 that may be performed in machining a broadhead of the present disclosure. Initial machining may be performed on a first spindle 410. Machining performed on the first spindle may include, in some embodiments, the majority of the rough machining of the broadhead. In other embodiments, any portion of the broadhead may be machined on the first spindle. In some embodiments, all except the point 106 and contours 114 of the broadhead may be rough machined on the first spindle. That is, the attachment mechanism, blades, and shaft of the broadhead may be machined on the first spindle. FIG. 8 shows an example of the machining that may be performed on a first spindle according to some embodiments. As shown, the partially machined broadhead 800 may not yet have a point and may instead have an elongated shaft section 830 connected to the bar stock 810. In other embodiments, different quantities or areas of the broadhead may be machined on the first spindle. For example, in some embodiments, only the attachment mechanism may be machined on the first spindle. The first spindle may be a primary or front spindle on a screw machine, such as but not limited to a Swiss or Swiss-style screw machine.

With continued reference to FIG. 4, a machined, partially machined, or pre-machined broadhead may be cut 420 from a stock material, such as but not limited to a bar stock material for example. The broadhead may be cut from the material at any point during the machining or manufacturing process, but in some cases the cut may occur after the desired amount of machining is completed or substantially completed on the first spindle 410. For example, turning to FIG. 8, after the desired amount of machining on the first spindle is completed, the broadhead 800 may be cut from the bar stock 810 at the point where the elongated shaft 830 meets the bar stock. Generally, any suitable mechanism may be used to separate the machined, partially machined, or pre-machined broadhead from the stock material.

With continued reference to FIG. 4, subsequent machining may be performed on a second spindle 430. Machining performed on the second spindle may be machining of the point 106 and contours 114 of the broadhead, according to some embodiments. In other embodiments, different quantities or areas of the broadhead may be machined on the second spindle. In some embodiments, machining on the second spindle may generally complete rough machining of the broadhead. In other embodiments, machining may begin on the second spindle, or intermediate machining may be performed on the second spindle. The second spindle may be a sub-spindle or back spindle on a screw machine, such as but not limited to a Swiss or Swiss-style screw machine.

With continued reference to FIG. 4, a broadhead of the present disclosure may be heat treated 440. Heat treating may harden the broadhead and/or increase its strength or toughness in some embodiments. In some embodiments for example, heat treating may be used to increase the hardness of a broadhead to a Rockwell scale hardness level of C40-45 or more. In other embodiments, heat treating or other methods may be used to bring the hardness of the broadhead to any other suitable or desirable level. Heat treating may be performed with the use of a furnace or other apparatus. Any suitable process or method may be used to heat treat a broadhead of the present disclosure. In some embodiments, heat treating may occur at a point in the process after the broadhead has been rough machined. In other embodiments, heat treating may be performed on the raw material prior to machining or may occur in between machining steps. Heat treating may occur at any point during the process in other embodiments. In some embodiments, heat treating may occur in multiple steps or phases.

With continued reference to FIG. 4, a broadhead of the present disclosure may receive a black oxide coating 450. The black oxide coating may reduce reflectance of a broadhead of the present disclosure and/or may increase corrosion resistance. The black oxide coating may be applied to all of or a portion of a broadhead of the present disclosure. The black oxide coating may be applied with any suitable method or process. In other embodiments, in addition to or alternative to the black oxide coating, one or more other suitable coatings may be applied to a broadhead of the present disclosure. For example, different types of corrosion resistant coatings may be applied according to some embodiments. Aesthetic coatings may be applied according to some embodiments. A coating may be applied before, during, or after the broadhead machining or manufacturing process.

Figure 5:
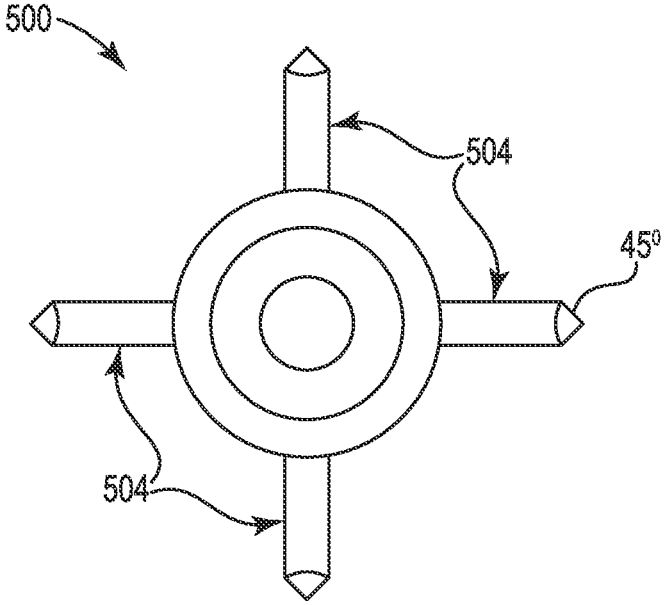
FIG. 5 is a schematic of an end view of a one-piece four-blade machined broadhead according to one embodiment of the present disclosure.

With continued reference to FIG. 4, one or more blades of a broadhead of the present disclosure may be ground or sharpened 460. In some embodiments, one or more blades may be ground to a particular angle. For example, FIG. 5 shows an end view of one embodiment 500 of a one-piece four-blade broadhead of the present disclosure, wherein each of the four blades 504 may be ground to a 45 degree included angle for a knife-like edge. In other embodiments, one or more blades of the broadhead may be ground to any suitable angle, which may be less or more than 45 degrees according to some embodiments. The one or more blades may be ground using a grinding wheel or any other suitable tool or process. The process may be performed on a Swiss screw machine or any other suitable machining or grinding apparatus.

In some embodiments, one or more steps of the broadhead machining or manufacturing described in the present disclosure may be automated. Such automation may be achieved in some embodiments by use of, for example, a robot or robotic arm. In some embodiments, a robot may have one or more gripping arms. A robot may, according to some embodiments, move a broadhead from one step to another during the machining process, or may load and/or unload a machine. For example, a robot may be used to facilitate the grinding process 460. One manner in which a robot may be used to facilitate the grinding process may involve the use of multiple robotic gripping arms. For example, a first robotic gripping arm may be used retrieve broadheads from an array, such as an array containing tens to hundreds or more broadheads for example, and load them, one at a time or more than one at a time if the grinding machine allows it or there are multiple grinding machines, into a grinder for the grinding process. Simultaneously, a second robotic gripping arm may be used to remove broadheads from the grinder after a grinding process is complete and return the broadheads to the array or other specified location. In this way, while the first robotic gripping arm is retrieving one broadhead from the array to load it in the grinder, the second robotic gripping aim may simultaneously be removing a different broadhead from the grinder and replacing it in the array. This process may repeat until each broadhead in the array has been ground. Traditionally, the process of loading and unloading broadheads into and out of the grinder was performed by a person, and typically only one broadhead was loaded/unloaded at a time. For example, a person would remove one broadhead from the grinder after the grinding was complete, return it to the array or other desired location, and then select a different broadhead to be loaded into the grinder. With the use of first and second robotic gripping arms, the entire array of broadheads may be ground in a faster and more efficient manner, requiring less human labor. Various types of robotic instruments having different functions may be used in other embodiments. Such use of a robot or robots may increase the speed with which a broadhead of the present disclosure may be machined or manufactured, and may increase the efficiency and/or decrease the cost of one or more steps or processes. Use of one or more robots may also decrease the need for human involvement in the process, which may in some cases increase workers' safety, decrease the amount of human error inherently involved, and/or decrease the man hours required for a broadhead machining or manufacturing operation. One or more robots used for the machining or manufacture of a broadhead of the present disclosure may be operated by or configured to receive computer-executable instructions. Such instructions may be input directly into the machine or may be received over a network.

Sharpener

The present disclosure, in some embodiments, further relates to a sharpener that may operate to sharpen blades of a one-piece four-blade machined broadhead of the present disclosure. Specifically, a sharpener of the present disclosure may be configured to sharpen two blades of a broadhead simultaneously. In this way, rather than merely sharpening one blade at a time on a four-blade broadhead, a sharpener of the present disclosure may increase efficiency and speed with which all four blades of the broadhead may be sharpened. In addition, a sharpener specific to a one-piece four-blade broadhead of the present disclosure may be desirable due to the angles between the irremovable blades. Because the broadhead is machined as a single piece, sharpening the blades with traditional sharpeners, rather than a sharpener of the present disclosure, may be less efficient or even impractical.

Figure 6:
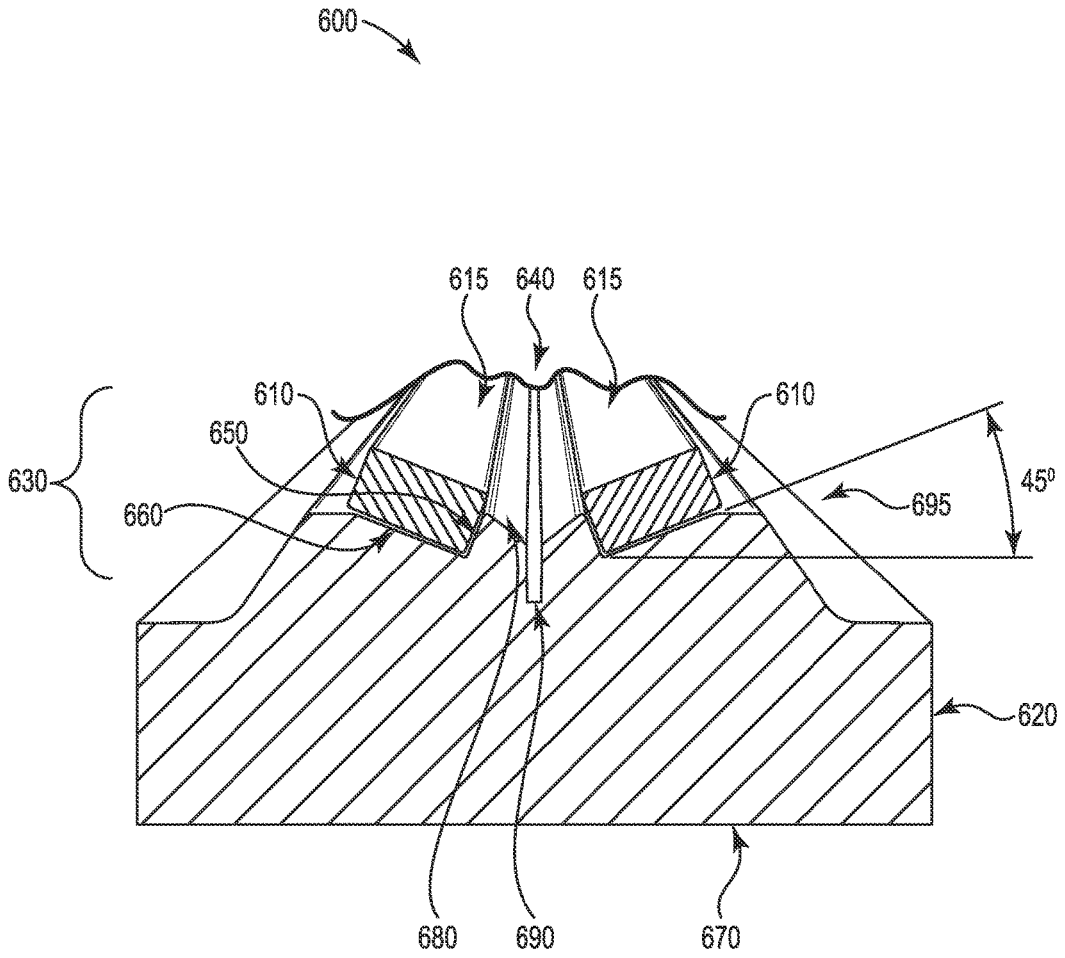
FIG. 6 is an end perspective view of a sharpener according to one embodiment of the present disclosure.
Figure 7:
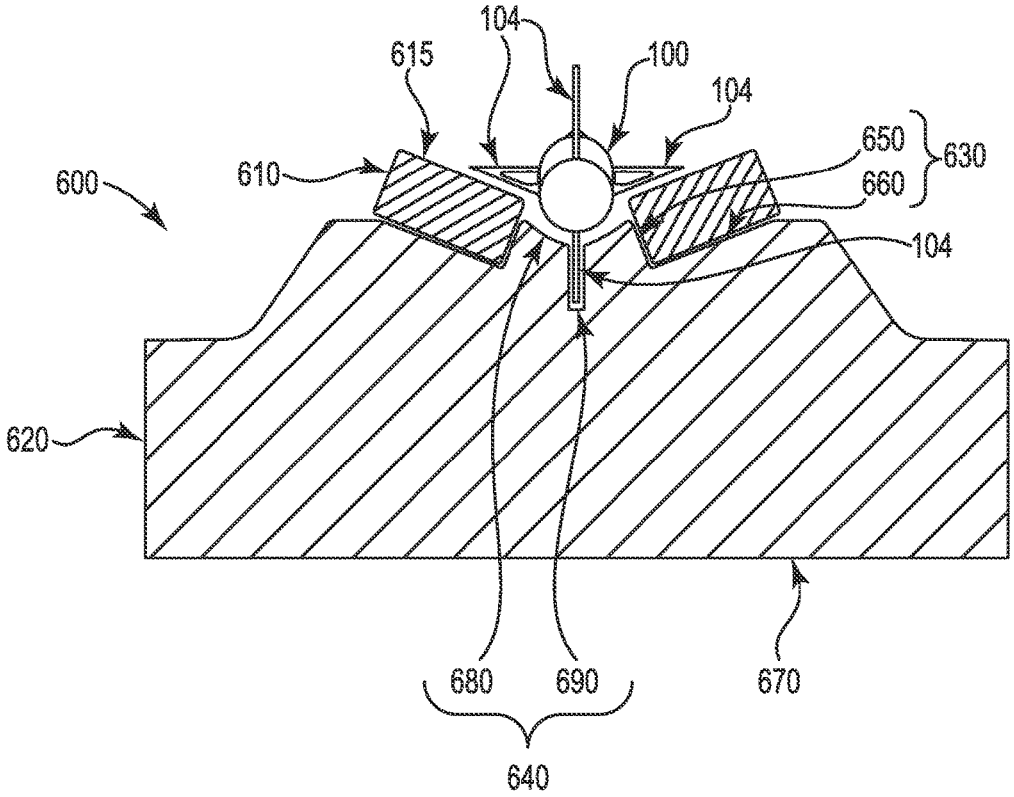
FIG. 7 is an end perspective view of a one-piece four-blade machined broadhead placed on the sharpener of FIG. 6.

FIG. 6 shows one embodiment of a sharpener 600 according to the present disclosure. The sharpener 600 may have one or more sharpening stones 610, but more typically may have two sharpening stones, and a base 620 having two ledges 630 and a gap 640. The majority of the body of the base 620 may have a generally rectangular prism-like shape or any other suitable shape and may support the one or more sharpening stones 610. Generally, the base 620 may have a flat surface on one side, such as a bottom side 670, so that the sharpener 600 may be placed on a table or other generally flat surface. Each sharpening stone 610 may be adjacent to an angled ledge 630 of the base 620. The ledge 630 may have a first surface 650 and a second surface 660 that are approximately 90 degrees apart. The first 660 and second 650 surfaces may be joined by any suitable angle, greater than or less than 90 degrees in other embodiments. The ledge 630 may operate to place the associated sharpening stone 610 at an angle such that a sharpening surface of the sharpening stone substantially aligns with the desired grind angle of a broadhead blade when the broadhead is placed on the sharpener 600. When a sharpening stone 610 is placed on a ledge 630, a sharpening surface or upper surface 615 of the stone may be generally parallel with the second surface 660. Moreover, where two sharpening stones 610 are each supported by a ledge 630, a broadhead may be placed on the sharpener 600, such that a different blade comes in contact with each of the sharpening stones, as shown in FIG. 7.

The base 620 may have a gap 640 between the ledges 630. The gap 640 may be sized or configured to receive or accommodate a portion of a four-blade broadhead. For example, the gap 640 may have a rounded portion 680 for receiving or accommodating a shaft of a broadhead, such as a shaft 102 of a broadhead 100 of the present disclosure. In other embodiments, the rounded portion 680 may have a different cross sectional shape, and may generally coincide with the cross sectional shape of the shaft of a four-blade broadhead. The rounded portion 680 may have a width or diameter of between 0.25 and 0.5 inches in some embodiments. In other embodiments, the rounded portion 680 may have any suitable width or diameter to receive or accommodate the shaft of a four-blade broadhead. The gap 640 may additionally or alternatively have a groove portion 690 sized or configured to receive or accommodate a blade of a four-blade broadhead. The groove portion 690 may be up to one inch in depth and may be up to 0.25 inches in width according to some embodiments. In other embodiments, the groove portion 690 may have any suitable depth and width, but generally may be deep and wide enough to accommodate the size of a broadhead blade without causing damage to the blade.

The one or more sharpening stones 610 may be attached or removably attached to the base 620 by any suitable attachment means according to different embodiments. In some embodiments, the sharpening stones 610 may simply rest on the base 620 without an attachment means. The sharpening stones 610 may be composed of aluminum oxide or other material(s) and may have various grit or grain levels in different embodiments. As one example, Gesswein EDM Polishing Stones with 220 grit may be used in some embodiments. Different or additional sharpening stones may be used in other embodiments. Sharpening stones 610 may have various dimensions. A sharpening stone 610 may have a rectangular prism shape according to some embodiments, or may generally have any suitable shape according to other embodiments. A sharpening stone 610 may be between about 4 and 6 inches in length, and between about 1/16 inch and ½ inch in width and thickness, according to some embodiments. Sharpening stones 610 may have any suitable dimensions according to other embodiments. In some embodiments, a grinding or sharpening material may be in a different form than a stone, such as but not limited to a sheet material for example.

In use, the sharpener 600 may be used to simultaneously sharpen two blades of a four-blade broadhead for example, such as but not limited to a machined one-piece four-blade broadhead of the present disclosure. To sharpen the blades of such a broadhead, the sharpener 600 may have two ledges 630 supporting two sharpening stones 610, and a gap 640 in the base 620 between the two ledges. Each of the ledges 630, and thus each of the adjacent sharpening stones 610, may be angled inward toward the gap 640 at an angle 695 matching that of the included grind angles of a broadhead's blades, which in some examples may be 45 degrees, as shown in FIG. 6. Of course, the angle 695 of the ledges 630 may be any other suitable or desirable angle. As shown in FIG. 7, a four-blade broadhead, such as but not limited to a four-blade broadhead 100 of the present disclosure, may be placed on the sharpener 600, such that the shaft of the broadhead and a first blade fit within the gap 640. A second and third blade may rest on each of the sharpening stones 610, such that the sharpening stones align with the blade's grind angles, and a fourth blade may point vertically upward away from the sharpener 600. The broadhead 100 may then be pushed or pulled along the sharpener 600 in order to simultaneously sharpen one side of each of the two blades adjacent to the two sharpening stones 610.

A one-piece four-blade machined broadhead and sharpener for sharpening the blades of a four-blade broadhead have been described. A broadhead of the present disclosure may be machined as a single piece from, for example, bar stock material. A broadhead of the present disclosure may be machined on a multi-spindle machine such as but not limited to a Swiss or Swiss-style screw machine. A broadhead may be machined in a "reverse" configuration, where an attachment mechanism is machined at an open end of the bar stock and a point of the broadhead is machined at the closed end of the bar stock. One or more steps of the broadhead machining or manufacturing process may be automated, for example by the use of one or more robots. Furthermore, a sharpener of the present disclosure may act to position sharpening stones at angles corresponding to grind angles of broadhead blades such that two blades of a four-blade broadhead may be simultaneously sharpened.

The broadhead machining processes and methods of the present disclosure may provide advantages over traditional machining processes and methods. The use of two spindles during the machining process, such that a portion of the rough machining may be performed on each of the two spindles, may reduce the average time to rough machine a broadhead. For example, whereas it may take an average of about seven minutes to rough machine a one-piece four-blade broadhead on a single spindle, machining the broadhead on two spindles by way of the "reverse" configuration discussed above may result in an average processing time of about five minutes per broadhead. That is, the use of two spindles allows for two broadheads to be rough machined simultaneously. A reduction in time to machine the broadheads may also lead to a reduction in manufacturing costs such as labor costs. In addition, the use of automating processes such as the use of one or more robotic gripping arms, as discussed above, may lead to time and cost savings. The robotic alms may increase the speed with which an array of broadheads may be ground, or the speed with which a different machining process may be performed, because one are may be loading one broadhead while a second arm unloads a second broadhead. Not only may the robotic gripping arms be able to complete the process more quickly than a human operator, but the use of one or more robotic aims may also reduce the cost of one or more processes, as fewer human labor hours may be needed. Thus, the machining processes and methods described in the present disclosure may allow broadheads, such as one-piece four blade broadheads of the present disclosure, to be machined more efficiently, which may lead to a more cost-effective product.

Various embodiments of the present disclosure may be described herein with reference to flowchart illustrations. Although a flowchart may illustrate a method as a sequential process, some of the operations in the flowcharts illustrated herein can be performed in parallel or concurrently. In addition, the order of the method steps illustrated in a flowchart may be rearranged for some embodiments. Similarly, a method illustrated in a flow chart could have additional steps not included therein or fewer steps than those shown.

As used herein, the terms "substantially" or "generally" refer to the complete or nearly complete extent or degree of an action, characteristic, property, state, structure, item, or result. For example, an object that is "substantially" or "generally" enclosed would mean that the object is either completely enclosed or nearly completely enclosed. The exact allowable degree of deviation from absolute completeness may in some cases depend on the specific context. However, generally speaking, the nearness of completion will be so as to have generally the same overall result as if absolute and total completion were obtained. The use of "substantially" or "generally" is equally applicable when used in a negative connotation to refer to the complete or near complete lack of an action, characteristic, property, state, structure, item, or result. For example, an element, combination, embodiment, or composition that is "substantially free of" or "generally free of" an ingredient or element may still actually contain such item as long as there is generally no measurable effect thereof.

In the foregoing description various embodiments of the present disclosure have been presented for the purpose of illustration and description. They are not intended to be exhaustive or to limit the invention to the precise form disclosed. Obvious modifications or variations are possible in light of the above teachings. The various embodiments were chosen and described to provide the best illustration of the principals of the disclosure and their practical application, and to enable one of ordinary skill in the art to utilize the various embodiments with various modifications as are suited to the particular use contemplated. All such modifications and variations are within the scope of the present disclosure as determined by the appended claims when interpreted in accordance with the breadth they are fairly, legally, and equitably entitled.

I claim:

1. A method of making a single-piece four-blade broadhead from a bar stock material, the broadhead having an attachment end for attaching to an arrow and a pointed end opposite the attachment end, the bar stock material having an open end, the method comprising machining the single-piece broadhead from the bar stock material such that an attachment end of the broadhead is nearer the open end of the bar stock than an end of the broadhead resulting in the pointed end;

wherein the machining is performed on a Swiss screw machine comprising a first spindle and a second spindle, wherein a first portion of the broadhead is machined on the first spindle and a second portion of the broadhead is machined on the second spindle; and wherein the first portion comprises all rough machining excluding at least a final point at the end of the broadhead resulting in the pointed end.

2. The method of claim 1, wherein the bar stock is steel bar stock.

3. The method of claim 1, further comprising heat-treating the broadhead.

4. The method of claim 1, further comprising applying a black-oxide coating to the broadhead.

5. The method of claim 1, wherein the second portion comprises at least the final point of the broadhead.

6. The method of claim 5, further comprising cutting the broadhead from the bar stock material after the first portion of the broadhead is machined, and before the second portion of the broadhead is machined.

7. The method of claim 1, further comprising grinding each of the broadhead's four blades to an included angle of about 45 degrees.

8. The method of claim 7, wherein a first robotic gripping arm and a second robotic gripping arm facilitate the grinding step.

9. The method of claim 8, wherein the first robotic gripping arm removes a first broadhead from an array of broadheads and loads the first broadhead into a grinder, and the second robotic gripping arm unloads the first broadhead from the grinder after grinding is complete.

10. A method of making a plurality of single-piece four-blade broadheads from a bar stock material, the method comprising:

machining each of the broadheads on a Swiss screw machine, wherein each broadhead comprises a single piece, and wherein the Swiss screw machine comprises a first spindle and a second spindle, wherein a first portion of each broadhead is machined on the first spindle and a second portion of each broadhead is machined on the second spindle, and wherein the first portion of each broadhead comprises all rough machining excluding at least a final point at an end of the broadhead;

placing the plurality of broadheads in an array; and for each of the plurality of broadheads:

using a first robotic gripping arm, removing the broadhead from the array and positioning it in a grinding machine;

grinding the four blades of the broadhead to an included angle; and using a second robotic gripping arm, removing the broadhead from the grinding machine.

11. The method of claim 10, wherein the included angle is about 45 degrees.

12. The method of claim 10, wherein the bar stock material is steel bar stock.

13. The method of claim 10, further comprising heat-treating each broadhead.

14. The method of claim 10, further comprising applying a black-oxide coating to each broadhead.

15. The method of claim 10, wherein the second portion comprises at least the final point of the broadhead.

16. The method of claim 15, further comprising cutting each broadhead from the bar stock material after the first portion of the broadhead is machined, and before the second portion of the broadhead is machined.

* * * * *